US008402901B1

(12) United States Patent
Bahnsen

(10) Patent No.: US 8,402,901 B1
(45) Date of Patent: Mar. 26, 2013

(54) LAZY SUSAN DEVICE AND ACCESSORIES

(76) Inventor: Scott M. Bahnsen, Oldsmar, FL (US)

( * ) Notice: Subject to any disclaimer, the term of this patent is extended or adjusted under 35 U.S.C. 154(b) by 19 days.

(21) Appl. No.: 13/115,190

(22) Filed: May 25, 2011

Related U.S. Application Data

(60) Provisional application No. 61/433,481, filed on Jan. 17, 2011.

(51) Int. Cl.
*A47B 57/00* (2006.01)

(52) U.S. Cl. ..... 108/94; 108/25; 99/426

(58) Field of Classification Search ..... 108/94, 108/20, 22, 25, 26, 27; D7/504; 211/10, 211/11, 12, 85.4; 99/424, 449
See application file for complete search history.

(56) References Cited

U.S. PATENT DOCUMENTS

| | | | | | |
|---|---|---|---|---|---|
| 618,219 | A | | 1/1899 | Bell | |
| 855,565 | A | * | 6/1907 | Greenhouse | 211/74 |
| 1,977,092 | A | | 10/1934 | Scurlock | |
| 1,978,695 | A | | 10/1934 | Clark | |
| 2,121,711 | A | | 6/1938 | Patts | |
| D129,530 | S | * | 9/1941 | Manaster | 211/74 |
| 3,511,172 | A | * | 5/1970 | Jones | 99/426 |
| 3,964,629 | A | * | 6/1976 | McCabe | D7/505 |
| D259,230 | S | * | 5/1981 | Snyder | D7/501 |
| 4,362,247 | A | | 12/1982 | Rueda | |
| D275,256 | S | | 8/1984 | Gilliam | |
| 4,573,570 | A | | 3/1986 | Cortopassi | |
| D293,994 | S | | 2/1988 | Conrady et al. | |
| 4,760,950 | A | * | 8/1988 | Levick | 229/103 |
| 4,827,638 | A | * | 5/1989 | Peters | 108/94 |
| D327,606 | S | * | 7/1992 | Oellig et al. | D7/504 |
| D334,867 | S | | 4/1993 | May | |
| 5,425,460 | A | * | 6/1995 | Barbarian | 211/77 |
| 5,479,867 | A | * | 1/1996 | Blevins et al. | 108/94 |
| 5,628,245 | A | * | 5/1997 | Baze | 99/426 |
| D392,852 | S | | 3/1998 | Weterrings et al. | |
| 6,182,839 | B1 | | 2/2001 | Robbins et al. | |
| D472,771 | S | | 4/2003 | McGuyer | |
| D489,938 | S | | 5/2004 | Vipond | |
| D496,831 | S | | 10/2004 | Strahota et al. | |
| 6,883,673 | B1 | * | 4/2005 | Gourley | 108/94 |
| D510,388 | S | * | 10/2005 | Siegel | D19/77 |
| D521,321 | S | | 5/2006 | McGuyer | |
| 7,083,070 | B2 | | 8/2006 | McGuyer | |
| 7,320,415 | B2 | | 1/2008 | McGuyer | |
| 7,565,864 | B2 | * | 7/2009 | Hart | 99/426 |
| D624,360 | S | * | 9/2010 | Leavelle | D7/501 |
| 7,934,449 | B2 | | 5/2011 | Anderson et al. | |

* cited by examiner

*Primary Examiner* — Jose V Chen
(74) *Attorney, Agent, or Firm* — Ronald E. Smith; Smith & Hopen, P.A.

(57) ABSTRACT

A lazy susan type device with accessories for facilitating a taco dinner. The lazy susan includes a plurality of openings adapted to removably receive a tortilla server and a taco holder. A burrito folder is provided as a separate accessory item but it is not received within said openings.

4 Claims, 6 Drawing Sheets

LAZY SUSAN DEVICE AND ACCESSORIES

CROSS REFERENCE TO RELATED APPLICATION

This application claims priority to U.S. Prov. Pat. Appl. No. 61/433,481, entitled "LAZY SUSAN DEVICE WITH OPENINGS FOR DISHES," filed on Jan. 17, 2011, the contents of which are hereby incorporated by reference.

BACKGROUND OF THE INVENTION

1. Field of the Invention

This invention relates generally to a lazy susan. More specifically, it relates to a lazy susan type device with accessories for facilitating a taco dinner.

2. Description of the Related Art

Lazy susans, also referred to as turntables, usually consist of a rotatable body having a surface upon which desired items may be placed. Lazy susans are often used for holding and providing access to various items, including food and/or condiments through rotation of the lazy susan.

Taco dinners have become a weekly routine for many families. A taco dinner usually includes providing stations, typically buffet style, for tortillas (both soft and hard), meat, cheese, lettuce, tomato, onion, hot sauce, sour cream, and any other food and/or condiment desired for a taco. With so many different items, space and organization becomes a premium. What is needed is a lazy susan type device with accessories that facilitate a taco dinner.

SUMMARY OF THE INVENTION

Generally speaking, the claimed invention is a lazy susan type device with accessories that facilitate a taco dinner. The lazy susan includes a rotatable tray having a thickness defined by a top surface and a bottom surface. The rotatable tray rotates about a base having a plurality of ball bearings in rotatable communication with the bottom surface of the rotatable tray such that the base is stationary and rotatable tray rotates. A plurality of openings extend through the thickness of the rotatable tray and are adapted to receive a corresponding accessory.

The plurality of opening are disposed around a peripheral of the rotatable tray and may further include an opening disposed at a center of the rotatable tray. In a preferred embodiment, the plurality of openings are circular and are adapted to be coupled with a removable bowl or other removable accessory.

An additional accessory may include a removable tortilla server. The term tortilla includes both a hard and soft tortilla. The tortilla server includes a base having a thickness defined by a top surface and a bottom surface. An inner rim extends downward from the bottom surface of the base to form a lip adapted to be removably couple with the plurality of openings. A first T-shaped tortilla holder extending upward from the top surface of the base and is adapted to receive tortillas draped over the horizontal portion of the T. A second T-shaped tortilla holder may also extend upward from the top surface of the base, with the first T-shaped tortilla holder and the second T-shaped tortilla holder being different sizes to accommodate different sized tortillas.

An additional accessory may include a hard shell taco holder. The hard shell taco holder includes a base having a thickness defined by a top surface and a bottom surface. An inner rim extends downward from the bottom surface of the base to form a lip adapted to be removably couple with the plurality of openings. Two spaced, parallel walls extend upward from the base to form a U-shaped channel adapted to receive a hard shell taco.

An additional accessory may include a burrito folder. The burrito folder includes three rectangular panels disposed in abutting relation to one another and sharing a plane. The two outer rectangular panels of the three rectangular panels are hingedly connected to the middle rectangular panel, such that the outer rectangular panels can each be individually folded over the middle rectangular panel. A fourth rectangular panel is disposed transversely to the three rectangular panels, with the fourth rectangular panel being hingedly connected to the middle rectangular panel such that the fourth rectangular panel can be folded over a bottom portion of the three rectangular panels.

The above described lazy susan type device and accessories facilitate a taco dinner. The stations of meat, cheese, lettuce, tomato . . . etc. are each placed in a bowl. Each bowl is then positioned within an opening in the rotatable tray. This enables a user to rotate the tray to access each food and/or condiment desired. Similarly, the tortilla server and the hard shell taco holder may be positioned in an opening of the rotatable tray, allowing a user to rotate the tray to access tortillas and/or hard shell tacos. The burrito folder is a supplementary item that can be included in a taco dinner kit and facilitates the folding of a tortilla into a burrito.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
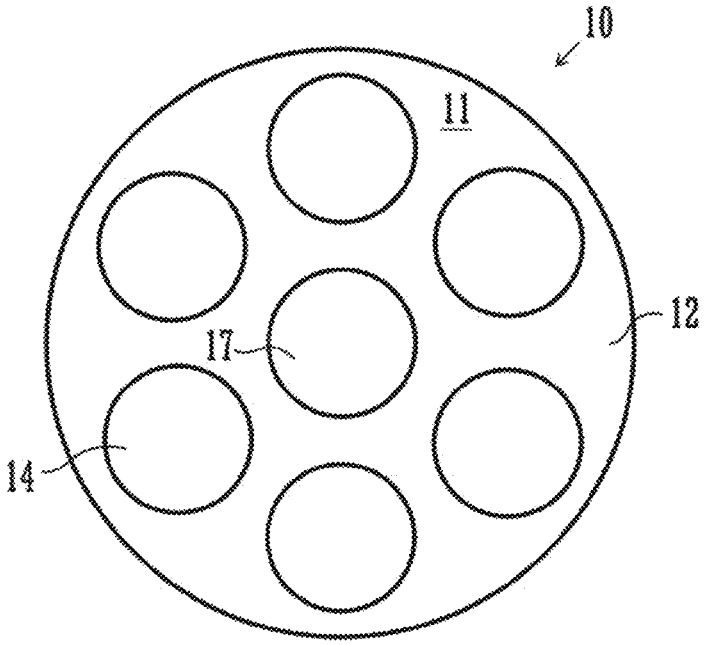
FIG. 1 is a top view of a lazy susan type device.
Figure 2:
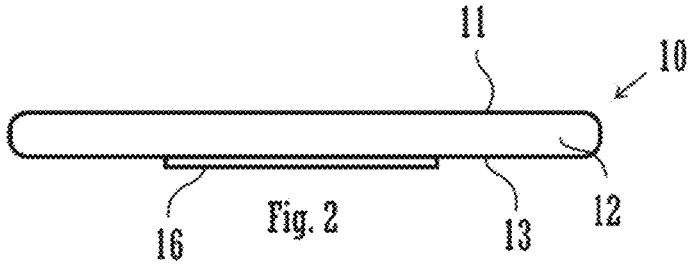
FIG. 2 is a side view of a lazy susan type device.
Figure 3:
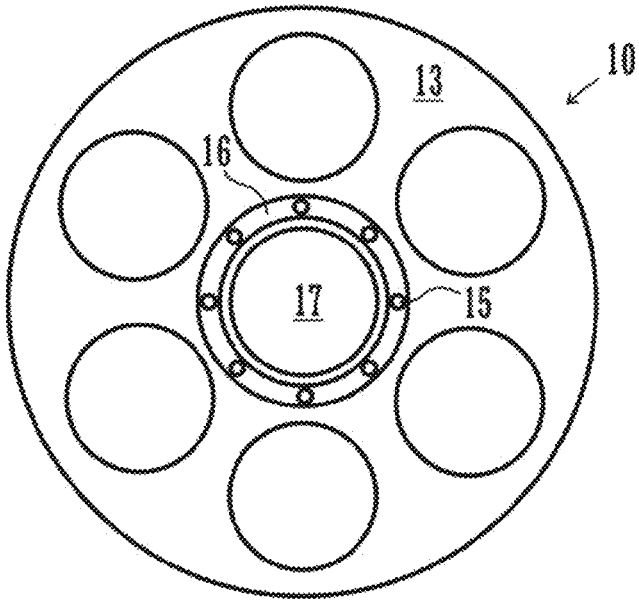
FIG. 3 is a bottom view of a lazy susan type device.

As depicted in FIGS. 1-3, the claimed invention is a lazy susan type device for facilitating a taco dinner. The lazy susan type device is generally denoted as reference 10 and includes a rotatable tray 12 having a thickness defined by a top surface 11 and a bottom surface 13. The rotatable tray 12 includes a plurality of openings 14 extending through the thickness of the rotatable tray 12. The plurality of openings 14 are adapted to receive a corresponding accessory. In an embodiment, the plurality of opening 14 are disposed around a peripheral of the rotatable tray 12 and may further include an opening 17 disposed at a center of the rotatable tray 12. In a preferred embodiment, the plurality of openings 14 are circular and are adapted to be coupled with a removable bowl or other accessory.

Figure 4:
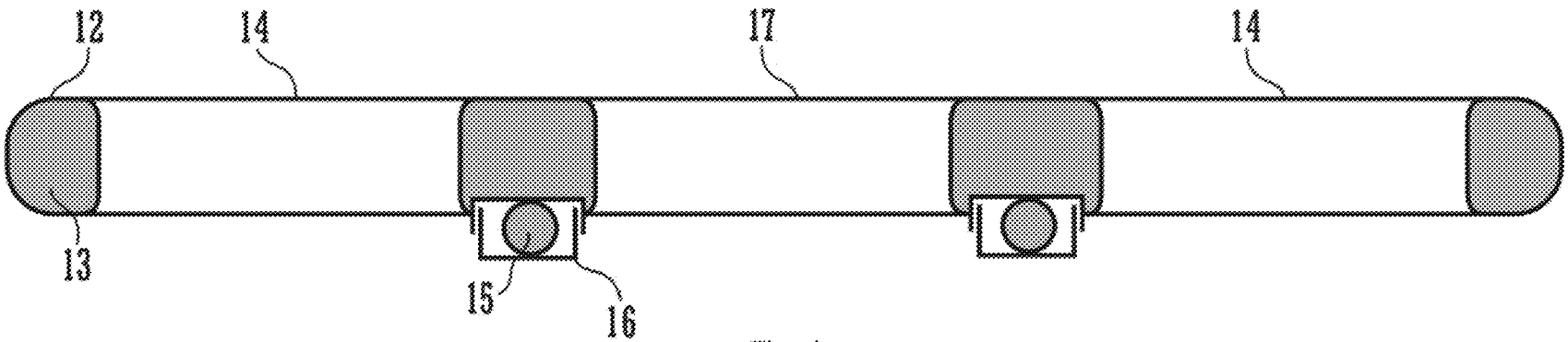
FIG. 4 is a cross sectional view of a lazy susan type device.
Figure 5:
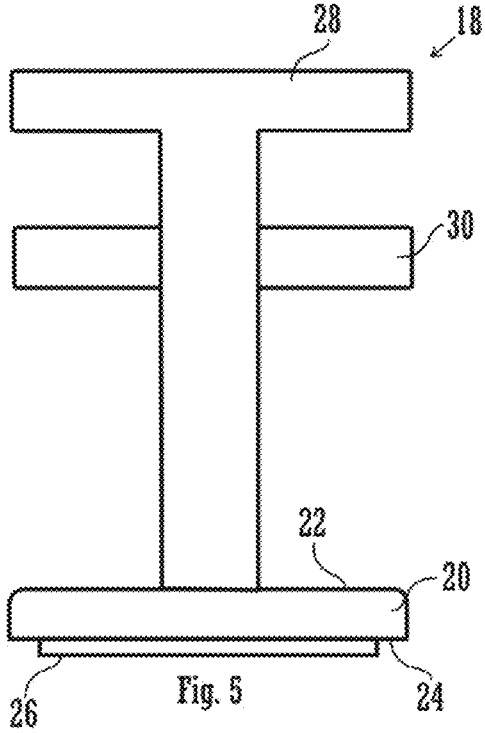
FIG. 5 is a front view of a tortilla server accessory.
Figure 6:
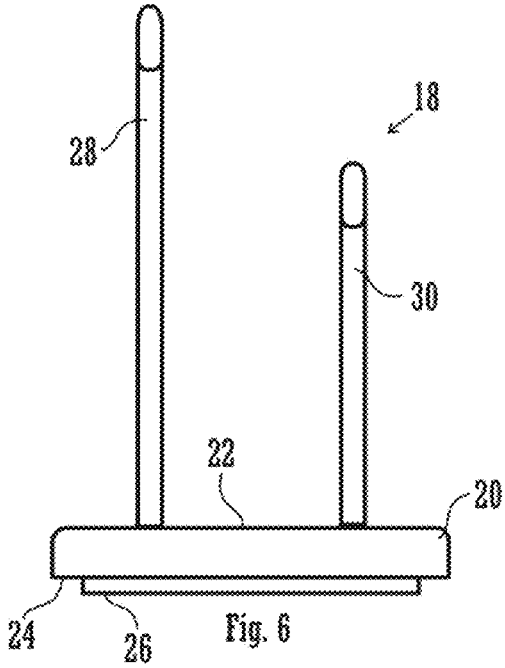
FIG. 6 is a side view of a tortilla server accessory.
Figure 7:
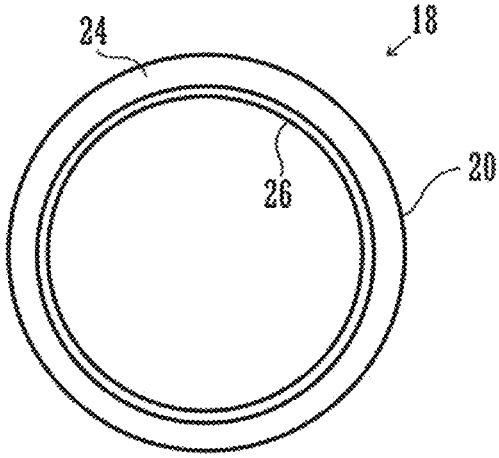
FIG. 7 is a bottom view of a tortilla server accessory.
Figure 8:
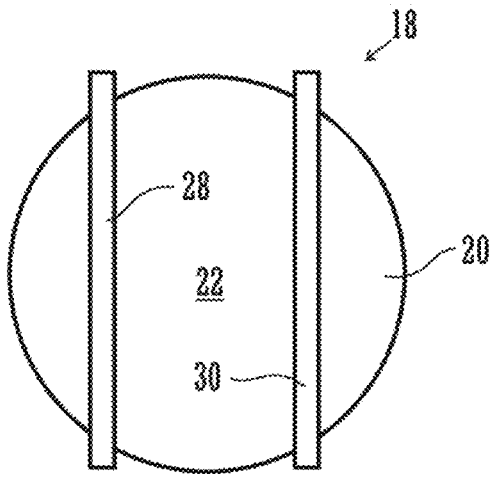
FIG. 8 is a top view of a tortilla server accessory.

As depicted in FIGS. 2-4, the rotatable tray 12 rotates about a base 16. The base 16 includes a plurality of ball bearings 15 in rotatable communication with the bottom surface 13 of the rotatable tray 12 such that the base 16 is stationary and rotatable tray 12 rotates.

As depicted in FIGS. 5-8, a corresponding accessory to the lazy susan type device 10 may includes a removable tortilla server 18. The tortilla server 18 includes a base 20 having a thickness defined by a top surface 22 and a bottom surface 24. An inner rim 26 extends downward from the bottom surface 24 of the base 20 to form a lip adapted to be removably couple with the plurality of openings 14. A first T-shaped tortilla holder 28 extending upward from the top surface 22 of the base 20 and is adapted to receive tortillas (or hard shell taco) draped over the horizontal portion of the T. A second T-shaped tortilla holder 30 may also extend upward from the top surface 22 of the base 20, with the first T-shaped tortilla holder 28 and the second T-shaped tortilla holder 30 being different sizes to accommodate different sized tortillas.

Figure 9:
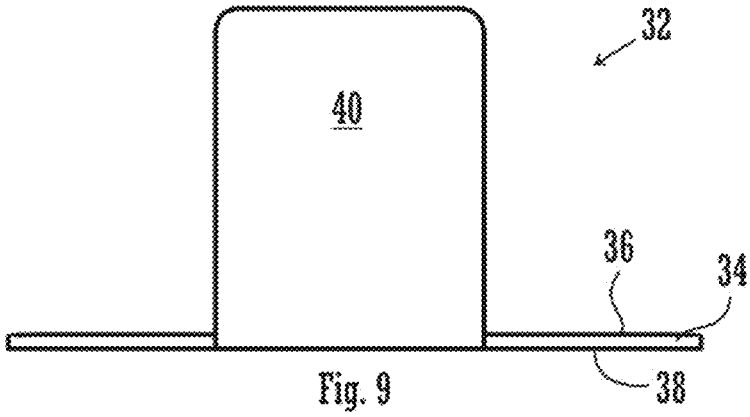
FIG. 9 is a side view of a taco holder accessory.
Figure 10:
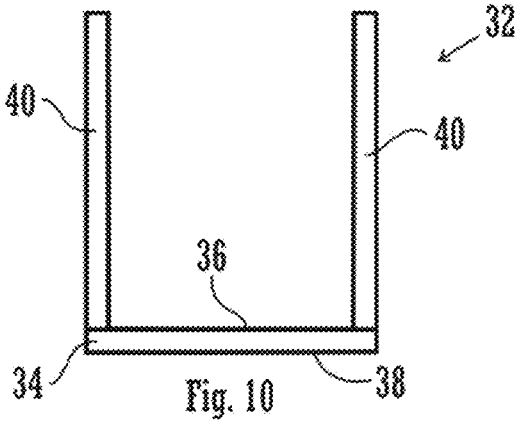
FIG. 10 is a front view of a taco holder accessory.
Figure 11:
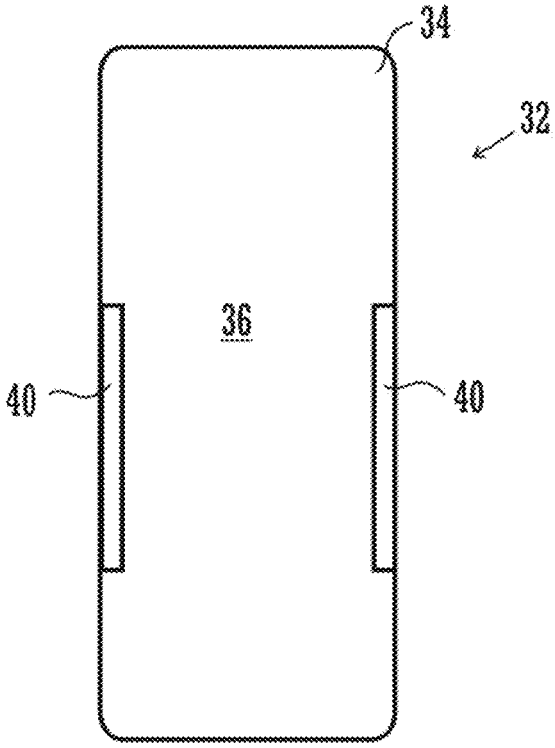
FIG. 11 is a top view of a taco holder accessory.
Figure 12:
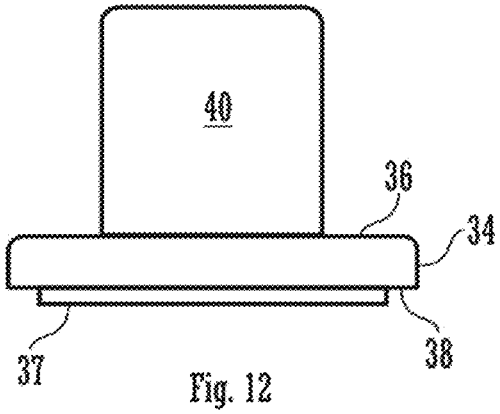
FIG. 12 is a side view of a taco holder accessory.
Figure 13:
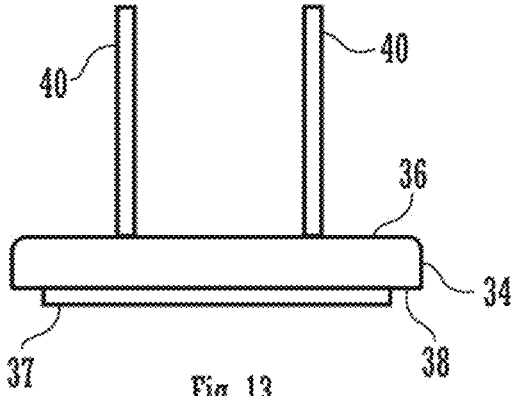
FIG. 13 is a front view of a taco holder accessory.
Figure 14:
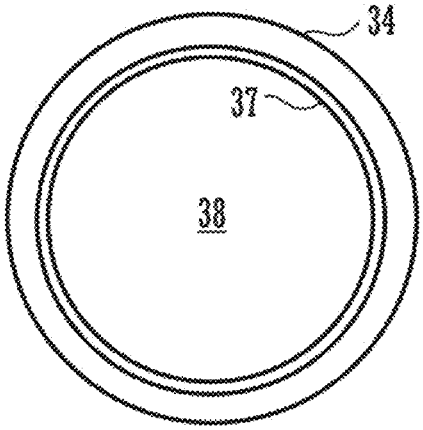
FIG. 14 is a bottom view of a taco holder accessory.
Figure 15:
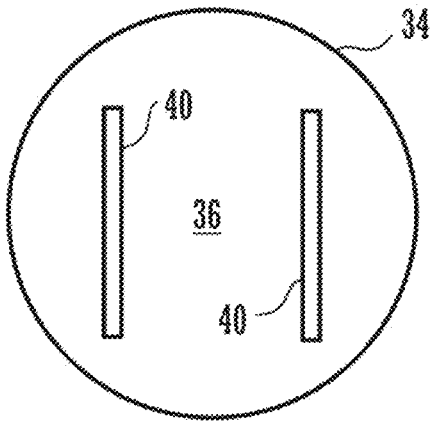
FIG. 15 is a top view of a taco holder accessory.

As depicted in FIGS. 9-11, a corresponding accessory may include a hard shell taco holder 32. The hard shell taco holder includes a base 34 having a thickness defined by a top surface 36 and a bottom surface 38. Two spaced, parallel walls 40 extend upward from the top surface 36 of the base 34 to form a U-shaped channel adapted to receive a hard shell taco. In an embodiment, as depicted in FIGS. 12-15, an inner rim extends 37 downward from the bottom surface 38 of the base 34 to form a lip adapted to be removably couple with the plurality of openings. The lip portion of the taco holder 32 is identical to the lip portion of the removeable tortilla server 18 as described above.

Figure 17:
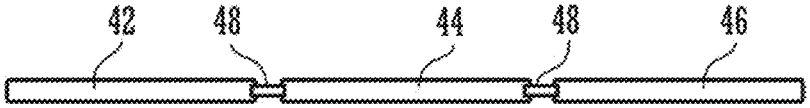
FIG. 17 is a top view of a burrito folder device.
Figure 16:
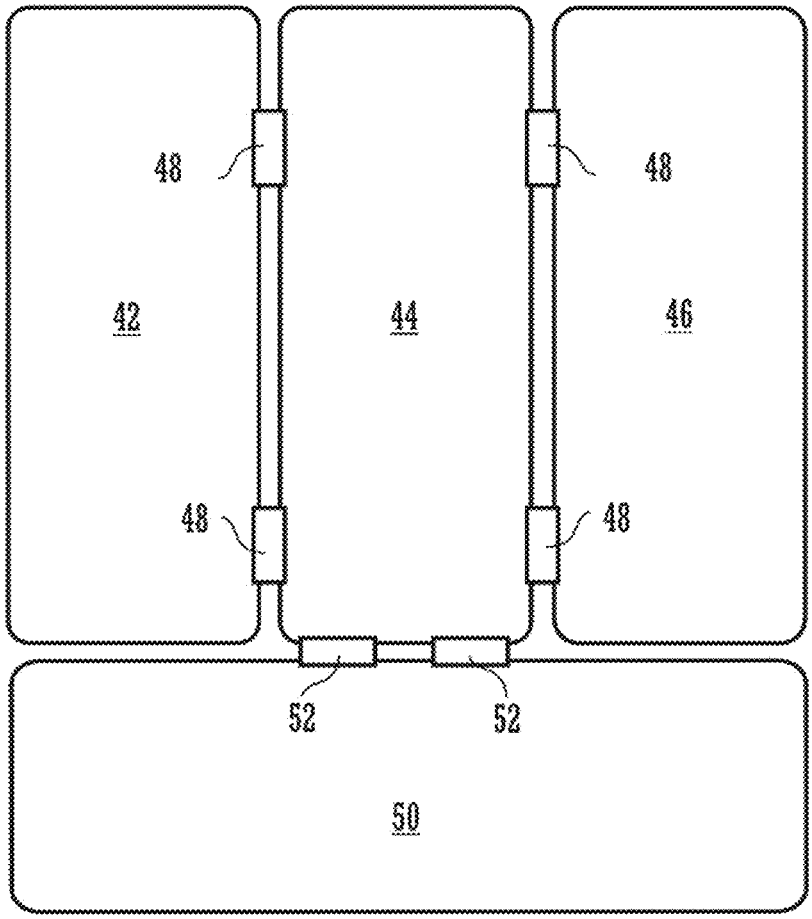
FIG. 16 is a front view of a burrito folder device.
Figure 18:
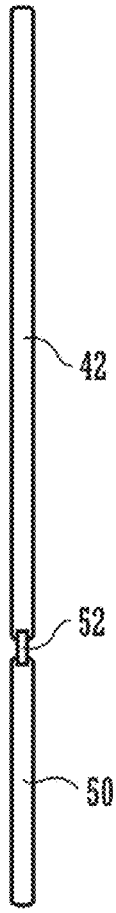
FIG. 18 is a side view of a burrito folder device.

As depicted in FIGS. 16-18, a corresponding accessory may include a burrito folder 40. The burrito folder 40 includes three rectangular panels 42, 44, 46 disposed in abutting relation to one another and sharing a plane. The two outer rectangular panels 42 and 46 are hingedly connected (via hinges 48) to the middle rectangular panel 44, such that the outer rectangular panels 42 and 46 are each individually folded over the middle rectangular panel 44. A fourth rectangular panel 50 is disposed transversely to the three rectangular panels 42, 44, 46, with the fourth rectangular panel 50 being hingedly connected (via hinges 52) to the middle rectangular panel 44 such that the fourth rectangular panel 50 can be folded over a bottom portion of the three rectangular panels 42, 44, 46.

It will thus be seen that the objects set forth above, and those made apparent from the foregoing disclosure, are efficiently attained. Since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein disclosed, and all statements of the scope of the invention that, as a matter of language, might be said to fall therebetween.

What is claimed is:

1. A burrito folder, comprising:

three rectangular panels disposed in abutting relation to one another and disposed in a common plane;

said three rectangular panels including a center panel and two outer panels;

said two outer panels being hingedly connected to said center panel; and a fourth rectangular panel disposed transversely to said three rectangular panels in said common plane, said fourth rectangular panel being hingedly connected to said center panel.

2. A lazy susan, comprising:

a rotatable tray having a top surface, a bottom surface, and a predetermined thickness;

a base having a plurality of ball bearings in rotatable communication with said bottom surface of said rotatable tray;

a central opening formed in said rotatable tray;

a plurality of openings formed in said rotatable tray in equidistantly and circumferentially spaced relation to one another about a periphery of said rotatable tray and in surrounding relation to said central opening and each opening of said plurality of openings adapted to receive an accessory, said accessories including a bowl adapted to hold food items;

each opening of said plurality of openings being circular and adapted to receive and support said bowl;

said accessories including a tortilla server;

said tortilla server having a flat base;

said tortilla server further including an annular lip depending from said base, each opening of said plurality of openings adapted to receive said annular lip; and a first T-shaped tortilla holder including a vertical part and a horizontal part, said vertical part extending upward from said base;

whereby a tortilla may be draped over said horizontal part.

3. A lazy susan as in claim 2, further comprising:

a second T-shaped tortilla holder including a vertical part and a horizontal part, said vertical part extending upward from said base, said first T-shaped tortilla holder and said second T-shaped tortilla holder having different sizes to accommodate tortillas having different sizes.

4. A lazy susan as in claim 2, further comprising:

said accessories including a hard shell taco holder;

said hard shell taco holder including a flat base and a pair of vertical walls mounted to said base in parallel, spaced apart relation to one another so that a hard shell taco can be placed in said space between said two walls;

said hard shell taco holder further including an annular lip depending from said bottom surface of said flat base, each opening of said plurality of openings adapted to receive said lip.

* * * * *